US012241323B2

(12) United States Patent
Samuel et al.

(10) Patent No.: US 12,241,323 B2
(45) Date of Patent: Mar. 4, 2025

(54) CONVEYANCE DEPLOYMENT SYSTEMS AND METHODS TO DEPLOY CONVEYANCES

(71) Applicant: Landmark Graphics Corporation, Houston, TX (US)

(72) Inventors: Robello Samuel, Cypress, TX (US); Yuan Zhang, Missouri City, TX (US); Vakkeyil Naveen Nair, Edmonton (CA)

(73) Assignee: Landmark Graphics Corporation, Houston, TX (US)

( * ) Notice: Subject to any disclaimer, the term of this patent is extended or adjusted under 35 U.S.C. 154(b) by 48 days.

(21) Appl. No.: 17/628,883

(22) PCT Filed: Oct. 30, 2019

(86) PCT No.: PCT/US2019/058914

§ 371 (c)(1),
(2) Date: Jan. 20, 2022

(87) PCT Pub. No.: WO2021/034337

PCT Pub. Date: Feb. 25, 2021

(65) Prior Publication Data

US 2022/0251911 A1 Aug. 11, 2022

Related U.S. Application Data

(60) Provisional application No. 62/890,020, filed on Aug. 21, 2019.

(51) Int. Cl.

| | |
|---|---|
| ***E21B 23/00*** | (2006.01) |
| ***E21B 31/00*** | (2006.01) |
| ***E21B 31/107*** | (2006.01) |

(52) U.S. Cl.

CPC ..... *E21B 23/001* (2020.05); *E21B 31/005* (2013.01)

(58) Field of Classification Search

CPC ..... E21B 31/00; E21B 31/005; E21B 31/035; E21B 31/107; E21B 23/00; E21B 23/14

See application file for complete search history.

(56) References Cited

U.S. PATENT DOCUMENTS 5,448,911 A * 9/1995 Mason ..... E21B 44/00 73/152.47

6,490,500 B1 12/2002 McCulloch (Continued)

FOREIGN PATENT DOCUMENTS

KR 10-2008-0010177 A 1/2008

OTHER PUBLICATIONS

International Search Report and Written Opinion date mailed May 20, 2020, International PCT Application No. PCT/US2019/058914.

(Continued)

*Primary Examiner* — Kenneth L Thompson

(74) *Attorney, Agent, or Firm* — DeLizio, Peacock, Lewin & Guerra, LLP

(57) ABSTRACT

The disclosed embodiments include well operation evaluation systems and methods to analyze a broomstick chart of a well operation. The method includes receiving data indicative of a well operation involving deploying a conveyance to a predetermined location. The method also includes determining one or more conditions that impact deployment of the conveyance to the predetermined location. The method further includes determining a likelihood of occurrence of the one or more conditions. The method further includes determining one or more operations which, when performed by one or more tools used during the well operation, overcome the one or more conditions.

20 Claims, 8 Drawing Sheets

(56) References Cited

U.S. PATENT DOCUMENTS

| | | | | |
|---|---|---|---|---|
| 6,491,115 | B2 * | 12/2002 | Van Houwelingen | E21B 19/08 175/57 |
| 6,637,523 | B2 * | 10/2003 | Lee | E21B 1/00 175/48 |
| 7,730,967 | B2 | 6/2010 | Ballantyne et al. | |
| 7,766,087 | B2 * | 8/2010 | Kotsonis | E21B 43/10 166/381 |
| 8,818,779 | B2 | 8/2014 | Sadlier et al. | |
| 9,598,947 | B2 * | 3/2017 | Wang | E21B 44/00 |
| 9,803,462 | B2 * | 10/2017 | Ocalan | E21B 19/08 |
| 9,890,633 | B2 * | 2/2018 | Benson | E21B 47/18 |
| 10,094,209 | B2 * | 10/2018 | Gillan | E21B 7/067 |
| 10,982,525 | B2 * | 4/2021 | Zhan | E21B 3/02 |
| 11,481,706 | B2 * | 10/2022 | Tang | E21B 44/00 |
| 2002/0148646 | A1 | 10/2002 | Schultz et al. | |
| 2006/0185899 | A1 | 8/2006 | Alft et al. | |
| 2013/0341090 | A1 * | 12/2013 | Zeineddine | E21B 44/00 175/24 |
| 2013/0341093 | A1 * | 12/2013 | Jardine | E21B 7/00 703/2 |
| 2017/0145760 | A1 * | 5/2017 | Poyet | E21B 23/00 |
| 2017/0175446 | A1 * | 6/2017 | Fraser | E21B 1/12 |
| 2020/0024901 | A1 * | 1/2020 | Shor | E21B 44/04 |
| 2021/0404281 | A1 * | 12/2021 | Toffolo | E21B 31/005 |

OTHER PUBLICATIONS

Mitchell, R. F., et al., "How Good Is The Torque/Drag Model?" Society of Petroleum Engineers, (Jan. 1, 2007), pp. 62-71, DOI: 10.2118/105068-MS.

Haduch, G.A., et al., "Solution of Common Stuck Pipe Problems Through the Adaptation of Torque Drag Calculations," Paper 27490-MS presented at the SPE/IADC Drilling Conference, Dallas, Texas, USA, Feb. 15-18, 1994.

Johancsik, C.A., et al., "Torque and Drag in Directional Wells—Prediction and Measurement," Journal of Petroleum Technology, 36 (6), pp. 987-992, 1984, DOI: 10.2118/11380-PA.

* cited by examiner

CONVEYANCE DEPLOYMENT SYSTEMS AND METHODS TO DEPLOY CONVEYANCES

CROSS-REFERENCE TO RELATED APPLICATIONS

This International Application claims priority to and benefit of U.S. Provisional Application No. 62/890,020, filed Aug. 21, 2019, the disclosure of which is incorporated by reference herein in its entirety.

BACKGROUND

The present disclosure relates generally to conveyance deployment systems and methods to deploy conveyances.

Drill pipes, tubulars, and other types of conveyances are deployed in a wellbore during drilling operations. Some wellbores extend several thousand feet into the formation and are tortuous shaped. As a drill pipe moves through a wellbore, frictional forces and other forces exerted on the drill pipe decrease the hook load of the drill pipe. In some instances, the intensity of forces exerted on the drill pipe slows down or prevents movement of the drill pipe.

BRIEF DESCRIPTION OF THE DRAWINGS

Illustrative embodiments of the present disclosure are described in detail below with reference to the attached drawing figures, which are incorporated by reference herein, and wherein.

Figure 1:
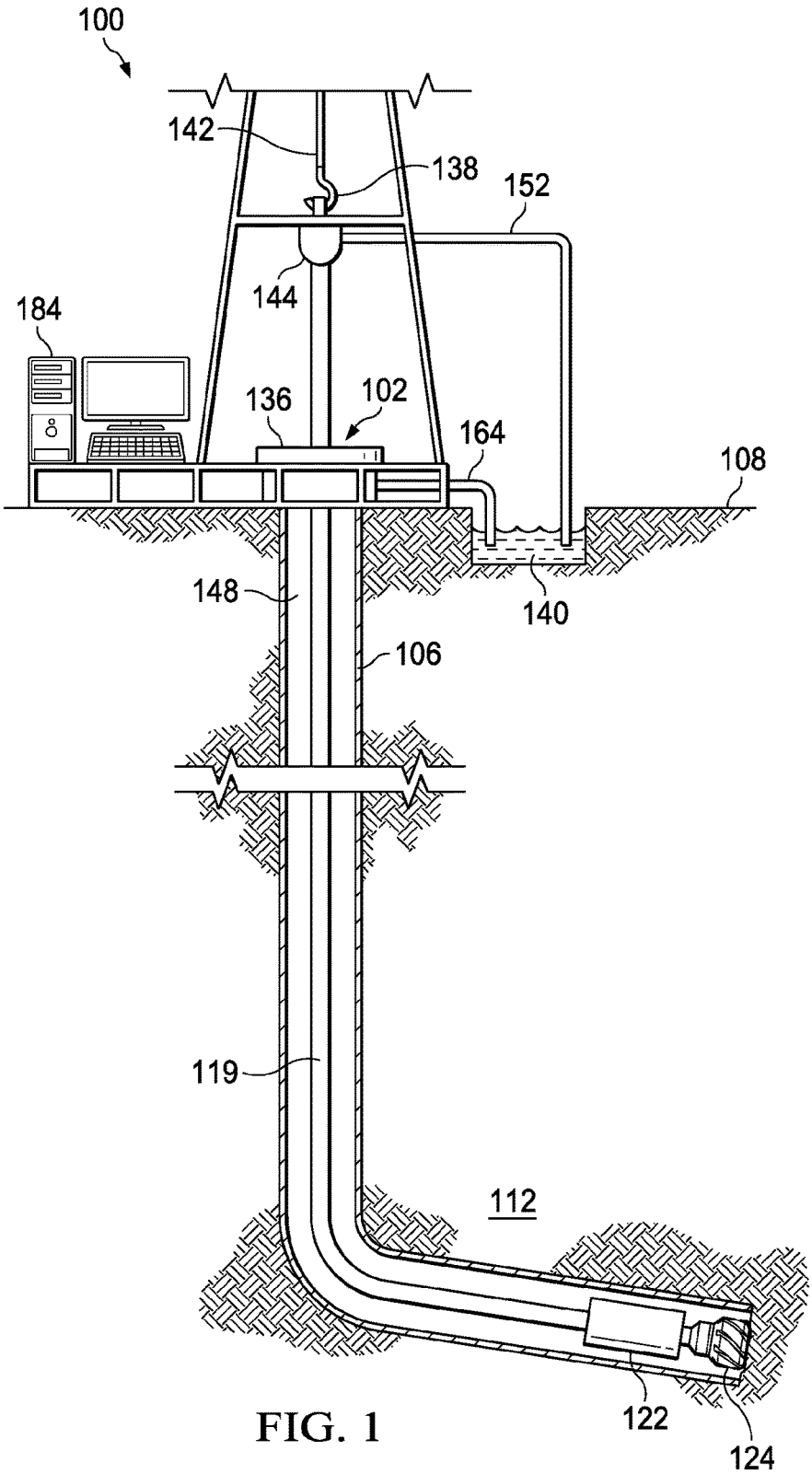
FIG. 1 is a schematic, side view of a drilling environment in which a conveyance deployment system is deployed.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to conveyance deployment systems and methods to deploy conveyances. The system receives data indicative of a well operation involving deploying a conveyance to a predetermined location. As referred to herein, a conveyance includes, but is not limited to, a drill string, drill pipe, wireline, slickline, coiled tubing, production tubing, downhole tractor, or another type of conveyance deployable in a wellbore. Further, as referred to herein, deployment of the conveyance includes any operation that causes any motion (such as movement, rotation, sliding) of the conveyance. Further, and as referred to herein, a well operation that involves deploying a conveyance includes, but is not limited to, a rotating-off-bottom operation, a rotating-on-bottom operation, a tripping-in operation, a tripping-out operation, a sliding operation, a backreaming operation, a fishing operation, as well as other types of well operations that involve deployment of the conveyance.

The system determines one or more conditions that impact deployment of the conveyance to the predetermined location. As referred to herein, conditions that impact deployment of the conveyance includes properties of the conveyance and properties of the wellbore. Examples of properties of the conveyance include, but are not limited to, the weight of the conveyance, the hook load of the conveyance, the frictional force experienced by the conveyance at a particular location, the material properties of the conveyance, as well as other measurable properties of the conveyance. Further, examples of properties of the wellbore include, but are not limited to, a type of mud used for the well operation, a type of lubricity used for the well operation, presence of a cuttings bed in a wellbore associated with the well operation, presence of a pack-off, a dogleg in the wellbore, a keyseat in the wellbore, a degree of curvature of the wellbore, a wellbore tortuosity of the wellbore, a viscous effect of the wellbore, a diameter of the wellbore, and an asperity between a conveyance used in the well operation and the wellbore, as well as other measurable properties of the wellbore.

In some embodiments, the system also generates one or more engineering models of the well operation and diagnoses the issue based on the results of one or more engineering models. Examples of engineering models used include, but are not limited to, a stiff-string model of the conveyance deployed during the well operation, a model of one or more wellbore doglegs of the wellbore, a wellbore clearance model, a hole-cleaning model, a cuttings pack-off model, as well as other types of models used to simulate one or more aspects of the well operation or the well. In some embodiments, the engineering models are based on one or more of the principles of engineering mechanics, dynamics, fluid mechanics and geo-mechanics.

The system determines a likelihood of occurrence of the one or more conditions. In one or more embodiments, the system runs an uncertainty model, such as the Monte Carlo model for a threshold number of iterations to determine the likelihood of the occurrence of the one or more conditions. In some embodiments, certain input parameters to an uncertainty model such as weight on bit, hook load, bit rotation, and torque may further depend on the other calculated values such as dogleg, torsion, torque, hook load and friction factors which also affect the prediction of the likelihood of certain conditions.

The system then determines one or more operations which, when performed by one or more tools used during the well operation, overcome the one or more conditions. Examples of tools include, but are not limited to, oscillation tools (e.g., oscillators) configured to oscillate at variable frequencies to move the conveyance in lateral directions relative to the direction of the drill bit, thrusters configured to generate thrust forces toward the drill bit and in an axial direction relative to the direction of the drill bit, and mechanical means such as kellies and top drives that are configured to rock the conveyance, as well as other tools that facilitate deployment (e.g., lateral movement, axial movement, and rocking) of the conveyance. As referred to herein, rocking refers to rotating a conveyance in one direction followed by rotating the conveyance in a different direction. An example of rocking the conveyance includes rotating the conveyance half a rotation (or a different amount of rotation) in one direction followed by rotating the conveyance half a rotation (or a different amount of rotation) in the opposite direction.

In some embodiments, the tools are coupled to the conveyance and are actuated to facilitate lateral movement, axial movement, rocking, or other types of motion to deploy the conveyance to the predetermined location (e.g., to a location of a lateral wellbore at a depth of 1,000 feet below the surface, and having a length of 5,000 feet from the surface. Continuing with the foregoing example, where the current location of the conveyance is 3,000 feet from the surface and at a depth of 800 feet below the surface, and the current operation is a rotating-on-bottom operation, the system determines which tools to actuate to facilitate deployment of the conveyance to the predetermined location. For example, where the system determines that the conveyance is experiencing a condition that would result in a stuck pipe, the system then actuates one or more oscillation tools positioned along the conveyance to oscillate the conveyance in lateral directions (side-to-side) to reduce the amount of friction experienced by the conveyance. Further, where the system determines to generate additional torque to deploy the conveyance to the predetermined location, the system requests a rocking operation (e.g., rotate half a rotation in one direction and back, rotate one rotation and back, etc.) to be performed (e.g., by a top drive that is coupled to the conveyance) to generate additional torque.

The system is configured to dynamically determine which of the one or more tools described herein to activate or simultaneously activate to overcome existing or potential conditions. In one or more of such embodiments, the system determines to generate additional torque to deploy the conveyance to the predetermined location by first determining which of the multiple tools to activate, and the operational settings of the tools such as, but not limited to, oscillation frequencies of the oscillation tools, the thrust force of the thruster, the speed, frequency, and number of times to rotate the conveyance. The system then requests the tools to operate at the determined operational settings. For example, the system determines to simultaneously request the top drive to perform a rocking operation at determined speed to rotate the conveyance a threshold number of rotations (e.g., ½ rotation ¾ rotation, 1 rotation, or another number of rotations as determined by the system) to rock the conveyance near the surface, request two oscillation tools that are coupled to different sections of the conveyance to operate at different frequencies to oscillate the conveyance at the two sections laterally, and request a thruster coupled to a section of the conveyance near the drill bit to generate a thrust force towards the drill bit and in a direction axial to the drill bit's direction of movement.

In some embodiments, the system, after determining the operations to overcome the one or more conditions, provides data indicative of the determined operations, such as, but not limited to, engaging the top drive to rock the conveyance at a determined speed and frequency, actuating one or more oscillation tools at the determined frequencies, and actuating one or more thrusters to generate the determined thrust force. In some embodiments, the system provides data indicative of the operations for display on an electronic device of an operator. In one or more of such embodiments, the system provides data indicative of the operations for display on user interfaces, such as the user interfaces illustrated in FIGS. 3A and 3B. Additional descriptions of user interfaces generated by the system are provided in the paragraphs below. In some embodiments, the system receives user-determined operations and operational settings. In one or more of such embodiments, the system requests tools associated with the user-determined operations to perform the operations at the user-determined settings.

In some embodiments, the system, after determining the operations to overcome the one or more conditions, dynamically approves the operations and requests corresponding tools to perform the operations. In one or more of such embodiments, the system dynamically approves the operations in response to determining that the likelihood of occurrence of the one or more conditions is greater than a threshold value (e.g., 40%, 60%, 75%, or another value). In one or more of such embodiments, the system dynamically approves the operations if the system provides an operator with data indicative of the operations for a threshold period of time (e.g., ten minutes, one hour, or another period of time) without receiving a response from the operator. In some embodiments, the system, after determining the operations to overcome the one or more conditions, provides data indicative of the determined operations to another electronic device that is configured to review the operations and to approve or reject the operations. In some embodiments, as one or more conditions change during a well operation, the system also dynamically changes or updates the operations performed by the tools to address new conditions. Additional examples of operations performed to facilitate deployment of the conveyance are provided in the paragraphs below.

Turning now to the figures, FIG. 1 is a schematic, side view of a drilling environment 100, in which a conveyance deployment system 184 is deployed. In the embodiment of FIG. 1, a well 102 having a wellbore 106 extends from a surface 108 of well 102 to or through a formation 112. A hook 138, cable 142, traveling block (not shown), hoist (not shown), and top drive 144 are provided to lower a conveyance 119 down wellbore 106 of well 102 or to lift conveyance 119 up from wellbore 106 of well 102. In one or more embodiments, conveyance 119 may be a drill string, drill pipe, wireline, slickline, coiled tubing, production tubing, downhole tractor or another type of conveyance operable to be deployed in wellbore 106. At a wellhead 136, an inlet conduit 152 is coupled to a fluid source (not shown) to provide fluids, such as drilling fluids, downhole. In the embodiment of FIG. 1, conveyance 119 has an internal cavity that provides a fluid flow path from surface 108 to a downhole location.

In some embodiments, the fluids travel down conveyance 119 and exit conveyance 119 at a drill bit 124. The fluids flow back toward surface 108 through a wellbore annulus 148 and exit the wellbore annulus 148 via an outlet conduit 164 where the fluids are captured in container 140. In some embodiments, conveyance 119 also provides telemetry of data indicative of one or more parameters of the well operation or the well 102.

A tool 122 is coupled to conveyance 119. Tool 122 represents any device or component which, when actuated, facilitates deployment of conveyance 119. Examples of tool 122 include, but are not limited to, oscillators, thrusters, as well as other types of devices or components operable to facilitate movement of conveyance 119. In some embodiments, sensors or transducers (not shown) are located at the lower end of conveyance 119. In one or more embodiments, sensors are built into a cylindrical drill collar that is positioned close to drill bit 124. While drilling is in progress, these sensors continuously or intermittently determine one or more parameters of the well operation or the well 102, and transmit the information to a surface detector by one or more telemetry techniques including, but not limited to, mud pulse telemetry, acoustic telemetry, and electromagnetic wave telemetry. In one or more embodiments, where a mud pulse telemetry system is deployed in wellbore 106 to provide telemetry, telemetry information is transmitted by adjusting the timing or frequency of viable pressure pulses in the drilling fluid that is circulated through conveyance 119 during drilling operations. In one or more embodiments, an acoustic telemetry system that transmits data via vibrations in the tubing wall of conveyance 119 is deployed in wellbore 106 to provide telemetry. More particularly, the vibrations are generated by an acoustic transmitter (not shown) mounted on conveyance 119 and propagate along conveyance 119 to an acoustic receiver (not shown) also mounted on conveyance 119. In one or more embodiments, an electromagnetic wave telemetry system that transmits data using current flows induced in conveyance 119 is deployed in wellbore 106 to provide telemetry. Additional types of telemetry systems may also be deployed in wellbore 106 to transmit data from tools (not shown) and other downhole components to conveyance deployment system 184.

In some embodiments, a surface-based electronic device, such as conveyance deployment system 184, includes one or more processors operable to receive data indicative of a well operation that involves deploying a conveyance to a predetermined location in wellbore 106. Examples of parameters of the well operation or well 102 include, but are not limited to, a frictional force experienced by conveyance 119 and tool 122 used in the well operation, the diameter of the wellbore 106, the type of lubricity used for the well operation, presence of the cuttings bed in the wellbore 106, presence of the pack-off, the dogleg in the wellbore 106, the keyseat in the wellbore 106, the degree of curvature of the wellbore 106, the wellbore tortuosity of the wellbore 106, the viscous effect of the wellbore 106, the diameter of the wellbore 106, the asperity between the conveyance used in the well operation and the wellbore 106, as well as other parameters related to the well operation or the well 102. In such embodiments, data obtained prior to and during the well operation are transmitted to conveyance deployment system 184 and are processed by the processors of the conveyance deployment system 184. The processors are further operable to cause conveyance deployment system 184 to perform operations described herein to determine conditions that impact deployment of the conveyance 119 to the predetermined location.

For example, the processors are operable to perform the following calculations to determine friction experienced by conveyance 119 during different well operations.

$$\mu_d = \mu_v \times \frac{|V_{ts}|}{\left|\sqrt{(V_{ts})^2 + (\omega)^2}\right|} \quad \text{Equation 1}$$

where ω is the rotational speed of conveyance 119, $V_{ts}$ is the trip speed of conveyance 119, and $\mu_v$ is the rotation coefficient of friction, and torque is expressed as $$\mu_t = \mu_v \times \frac{|\omega|}{\left|\sqrt{(V_{ts})^2 + (\omega)^2}\right|} \quad \text{Equation 2}$$

In some embodiments, where during rotating-on-bottom (i.e during drilling), the axial velocity component of conveyance 119 is much smaller relative to the conveyance rotation, the friction is neglected. However, during sliding operation, friction is not neglected as the ratio becomes one for axial load calculations. In the case of conveyance oscillation, conveyance 119 is rotated to a certain length of conveyance 119.

With dynamic motion, friction is modified as effective friction and is expressed as follows:

$$\mu_d = \frac{\mu_v}{\sqrt{1 + \mu_v^2}} \times \frac{|V_{ts}|}{\left|\sqrt{(V_{ts})^2 + (\omega)^2}\right|} \quad \text{Equation 3}$$

and torque is expressed as $$\mu_t = \frac{\mu_v}{\sqrt{1 + \mu_v^2}} \times \frac{|\omega|}{\left|\sqrt{(V_{ts})^2 + (\omega)^2}\right|} \quad \text{Equation 4}$$

where ω is the rotational speed of conveyance 119, $V_{ts}$ is the trip speed of conveyance 119, and $\mu_v$ is the rotation coefficient of friction.

The processors are further operable to determine a likelihood of occurrence of the one or more conditions, determining one or more operations which, when performed by tool 122, overcome the one or more conditions. In some embodiments, conveyance deployment system 184 represents an electronic device of an operator working on the well operation or working at well 102. In one or more of such embodiments, conveyance deployment system 184 provides the likelihood of occurrence of one or more conditions (e.g., there is a 30% likelihood that continued drilling for another 50 feet will result in conveyance 119 being stuck), and a proposed solution to overcome the condition (e.g., actuate tool 122 to rotate conveyance 119) to the operator. In one or more of such embodiments, the operator interacts with conveyance deployment system 184 to actuate tool 122 or to configure one or more settings of tool 122 to overcome the condition. In some embodiments, conveyance deployment system 184 is operable to dynamically actuate tool 122. In one or more of such embodiments, conveyance deployment system 184 actuates tool 122 if the operator does not authorize a response within a threshold period of time. Additional descriptions of the processors and operations performed by the processors are described in the paragraphs below.

Although FIG. 1 illustrates conveyance deployment system 184 as a surface-based electronic device, in some embodiments, conveyance deployment system 184 is located downhole or is located in another surface-based location remote from well 102. In some embodiments, conveyance deployment system 184 also includes drill bit 124, tools (not shown) deployed downhole during the well operation, as well as sensors (not shown) operable to measure one or more parameters of the well operation or the well 102. Although FIG. 1 illustrates one tool 122, additional tools (not shown) may be coupled to conveyance 119 and may be actuated by conveyance deployment system 184 to facilitate deployment of conveyance 119. Although FIG. 1 illustrates a drilling environment, conveyance deployment system 184 may also be deployed in logging while drilling, measurement while drilling, and pre-drilling operations, during which conveyance 119 is tripped into or tripped out of wellbore 106.

Figure 2A:
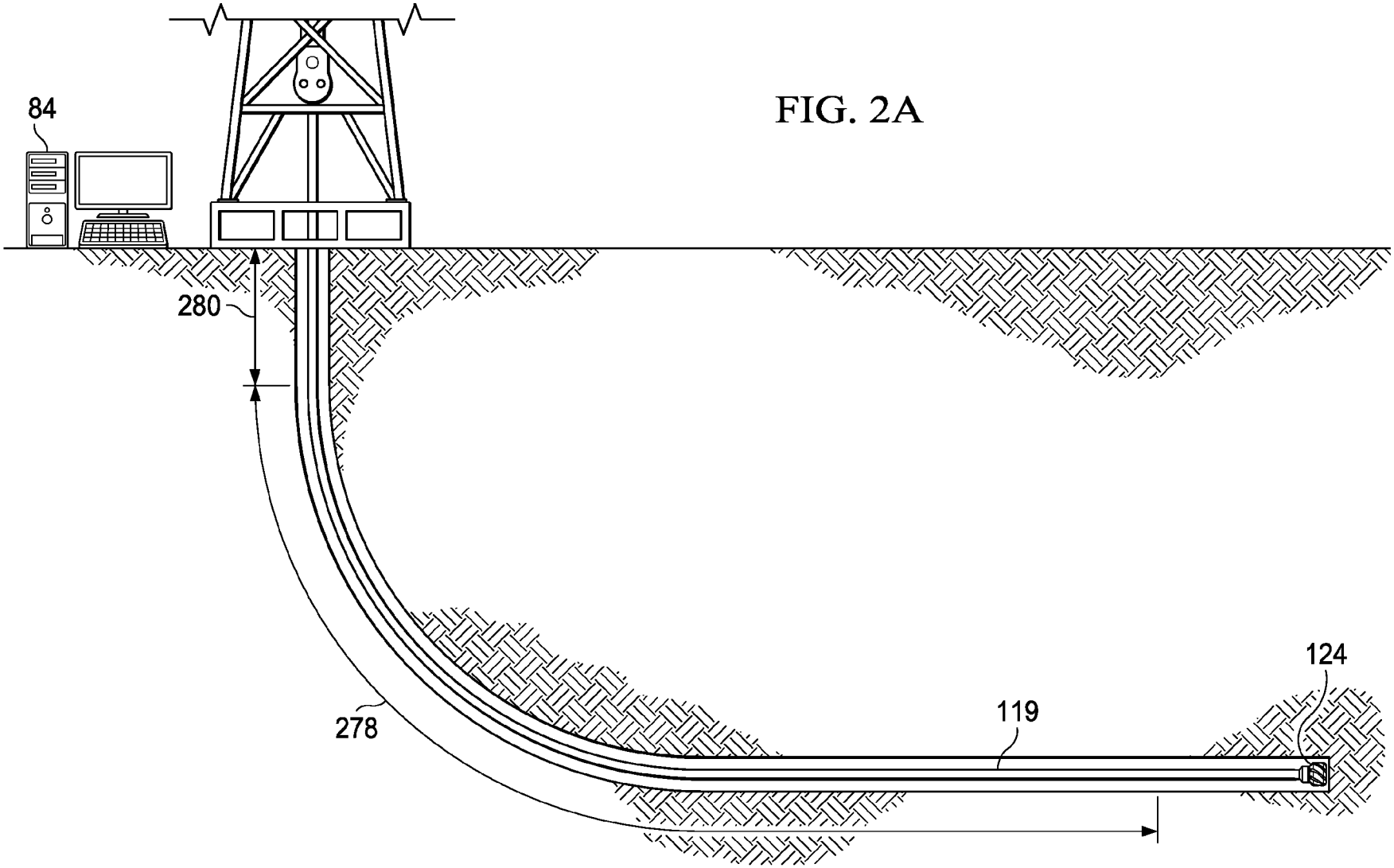
FIG. 2A is a schematic, side view of an environment in which the conveyance of FIG. 1 without any tools is deployed in a wellbore.

FIG. 2A is a schematic, side view of an environment in which conveyance 119 of FIG. 1 without any tools is deployed in a wellbore. As shown in FIG. 2A, conveyance deployment system 184 requests a rocking operation to be performed on conveyance 119. Further, drill bit 124 is attached to one end of conveyance 119 to perform drilling operations. In one or more embodiments, a mechanical force is applied at the surface (e.g., through the kelly, top drive 144 of FIG. 1, or other mechanical means) to rock conveyance 119 back and forth. As referred to herein, rocking refers to rotating a conveyance in one direction (e.g., clockwise) followed by rotating the conveyance in a different direction (e.g., counterclockwise). An example of rocking conveyance 119 includes rotating conveyance 119 half a rotation (or a different amount of rotation) in one direction followed by rotating conveyance 119 half a rotation (or a different amount of rotation) in the opposite direction. In the embodiment of FIG. 2A, the rocking operation performed on conveyance 119 causes a section 280 of conveyance 119 to rotate and causes another section 278 of conveyance 119 to rock (e.g., move laterally). In one or more of such embodiments, the length of sections 280 and 278 are directly proportional to the number of rotations conveyance 119 is rotated.

Figure 2B:
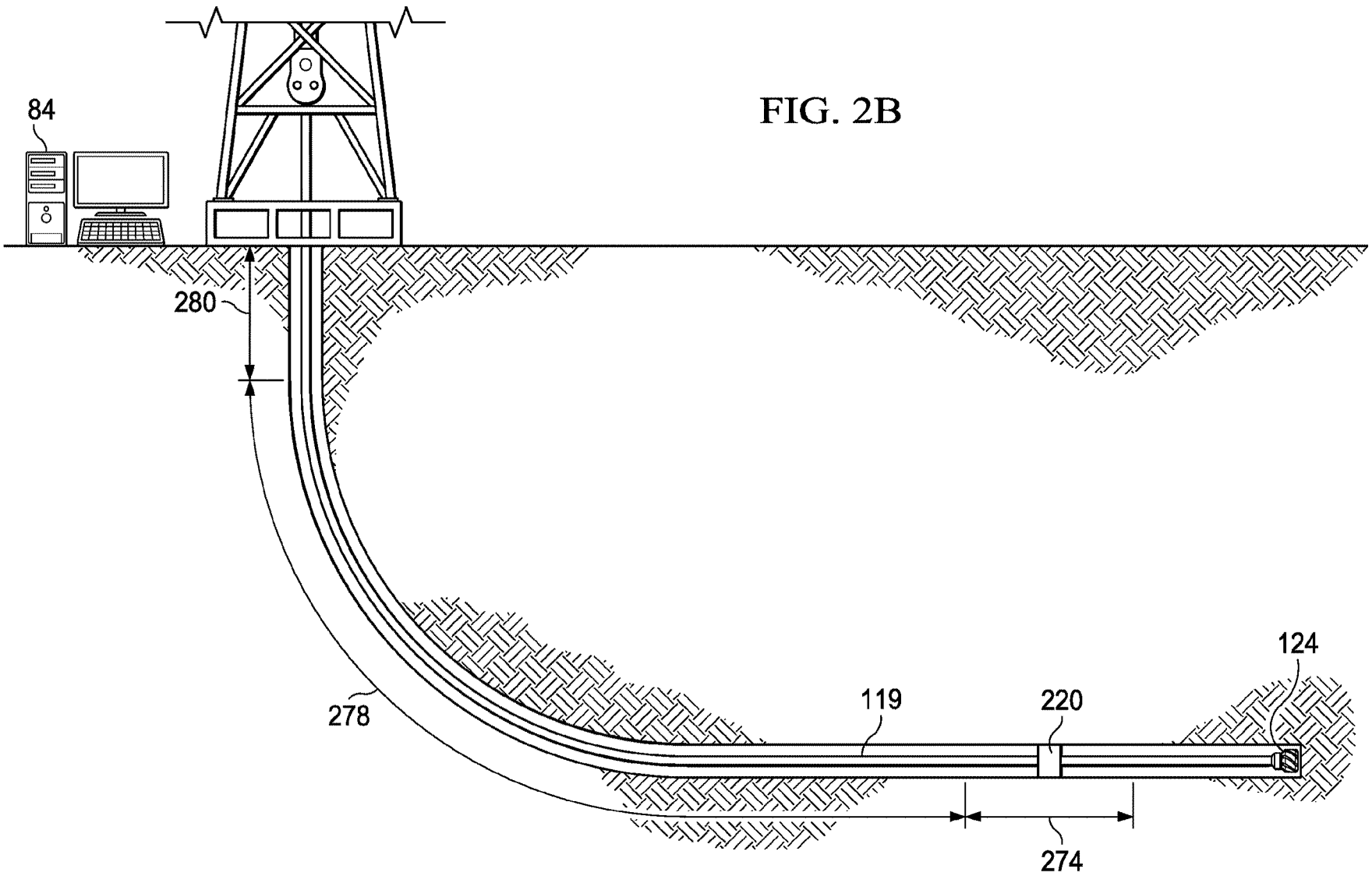
FIG. 2B is a schematic, side view of an environment in which the conveyance of FIG. 1 having one oscillation tool is deployed in a wellbore.

FIG. 2B is a schematic, side view of an environment in which conveyance 119 of FIG. 1 having one oscillation tool 220 is deployed in a wellbore. As shown in FIG. 2B, oscillation tool 220 is coupled to conveyance 119. As shown in FIG. 2B, oscillation tool 220 is coupled to section 274 of conveyance 119. Further, drill bit 124 is attached to one end of conveyance 119 to perform drilling operations. In the illustrated embodiment, conveyance deployment system 184, in addition to requesting a rocking operation, also actuates oscillation tool 220 to perform oscillations along section 274 of conveyance 119 to reduce friction experienced by conveyance 119 in the oscillation section. In the embodiment of FIG. 2B, the rocking operation performed on conveyance 119 causes a section 280 of conveyance to rotate and causes another section 278 of conveyance 119 to rock. Further, actuation of oscillation tool 220 generates lateral movements of section 274 of conveyance 119.

In some embodiments, conveyance deployment system 184 is operable to adjust one or more oscillation settings (e.g., the frequency of oscillation, the oscillation magnitude, or another setting) to facilitate deployment of conveyance 119. In some embodiments, the length of section 274, which moves laterally due to oscillations generated by oscillation tool 220, is based on the intensity of the oscillations generated by oscillation tool 220. In some embodiments, oscillations of conveyance 119 result in selective depth rotation of conveyance 119 to overcome the sliding friction. In one or more of such embodiments, if the sliding friction is much greater than rotational friction, pipe rocking converts the sliding motion to sliding and rotational motion resulting in less friction and thereby lessening the drag on conveyance 119.

Figure 2C:
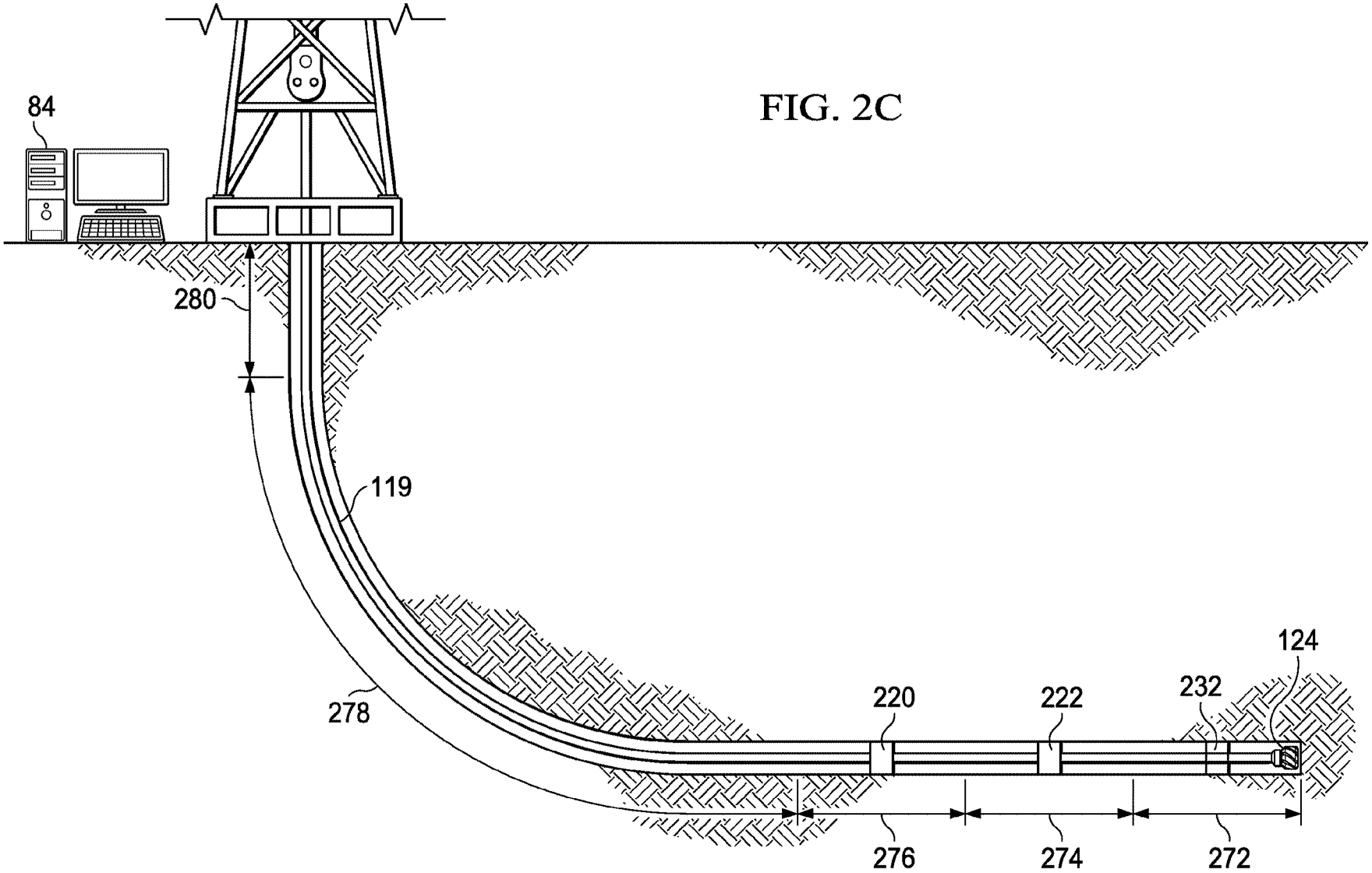
FIG. 2C is a schematic, side view of an environment in which a conveyance of FIG. 1 having two oscillation tools is deployed in a wellbore.

FIG. 2C is a schematic, side view of an environment in which a conveyance 119 of FIG. 1 having two oscillation tools 220 and 222, and a thruster 232 is deployed in a wellbore. As shown in FIG. 2C, thruster 232 is coupled to a section 272 of conveyance 119, oscillation tool 220 is coupled to section 276 of conveyance 119, and oscillation tool 222 is coupled to a section 274 of conveyance 119. Further, drill bit 124 is attached to one end of conveyance 119 to perform drilling operations. In the illustrated embodiment, conveyance deployment system 184, in addition to requesting a rocking operation, also actuates oscillation tools 220 and 222 to oscillate and generate lateral movements in section 274 and 276 of conveyance 119 to reduce friction experienced by conveyance 119 in the sections 274 and 276 of conveyance. Further, conveyance deployment system 184 also requests thruster 232 to generate a thrusting force towards drill bit 124 and a direction axial to the direction of movement of drill bit 124.

Figure 3A:
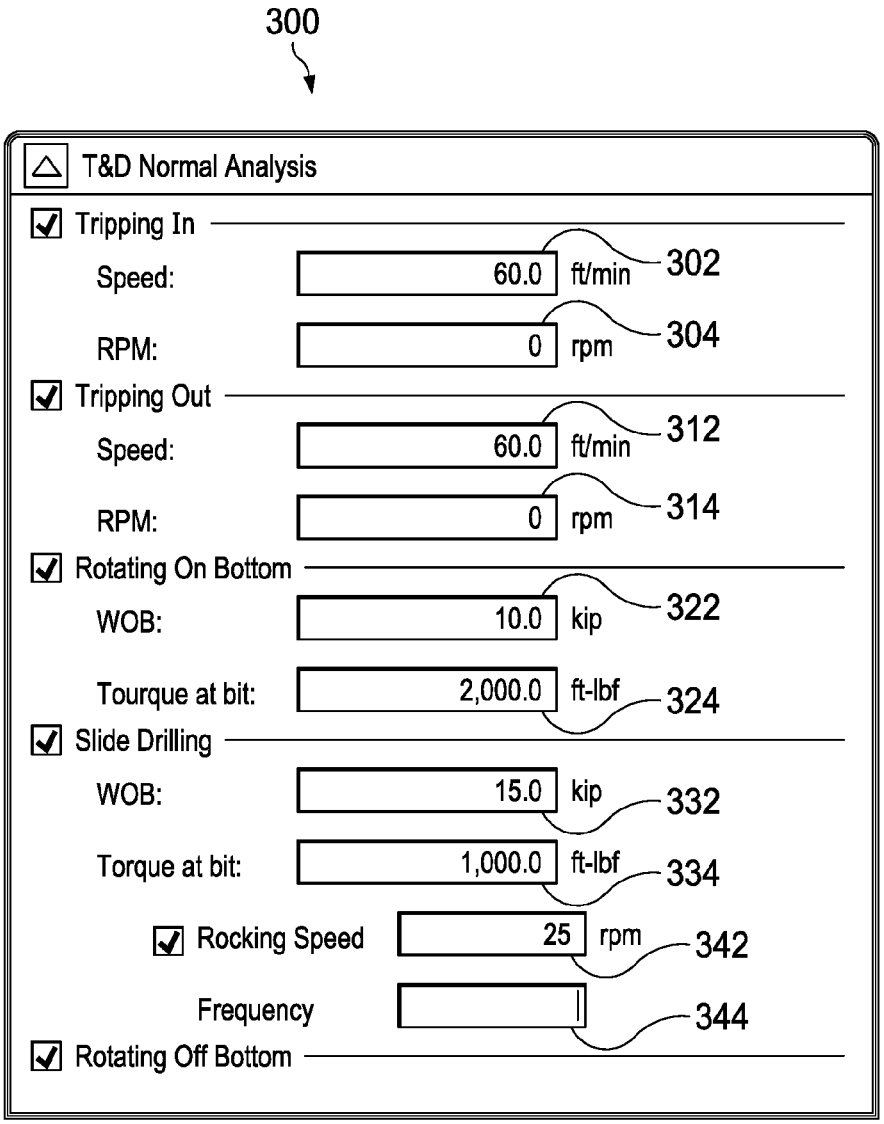
FIG. 3A is an illustration of a user interface provided by the conveyance deployment system of FIG. 1.

FIG. 3A is an illustration of a user interface 300 provided by the conveyance deployment system 184 of FIG. 1. In the illustrated embodiments, one or more inputs are user configurable and are entered by an operator. In one or more of such embodiments, conveyance deployment system determines which tools to actuate, as well as the setting of the actuated tools to satisfy parameters entered by the operator. In the embodiment of FIG. 3A, an operator enters the desired tripping-in speed into box 302, the desired tripping-in-rotations per minute in box 304, the desired tripping-out speed in box 312, the desired tripping-out-rotations per minute in box 314, the desired rotating-on-bottom weight on bit in box 322, the desired rotating-on-bottom torque at bit in box 324, the desired slide drilling weight on bit in box 332, the desired slide drilling torque at bit in box 334, the desired rocking speed in box 342, and the desired rocking frequency in box 344. Additional examples of user configurable inputs include, but are not limited to, rocking speed (with or without thrusters), the number of thrusters to actuate, the number of oscillation tools to actuate, oscillation frequency, oscillation magnitude, as well as other adjustable settings of tools actuated to facilitate deployment of the conveyance. In one or more of such embodiments, the conveyance deployment system dynamically determines values of the one or more parameters (e.g., dynamically determining and adjusting the tripping-in speed, the rotating-on-bottom weight on bit, the number of oscillation tools to actuate, the oscillation frequency, as well as other parameters) to facilitate deployment of the conveyance.

Figure 3B:
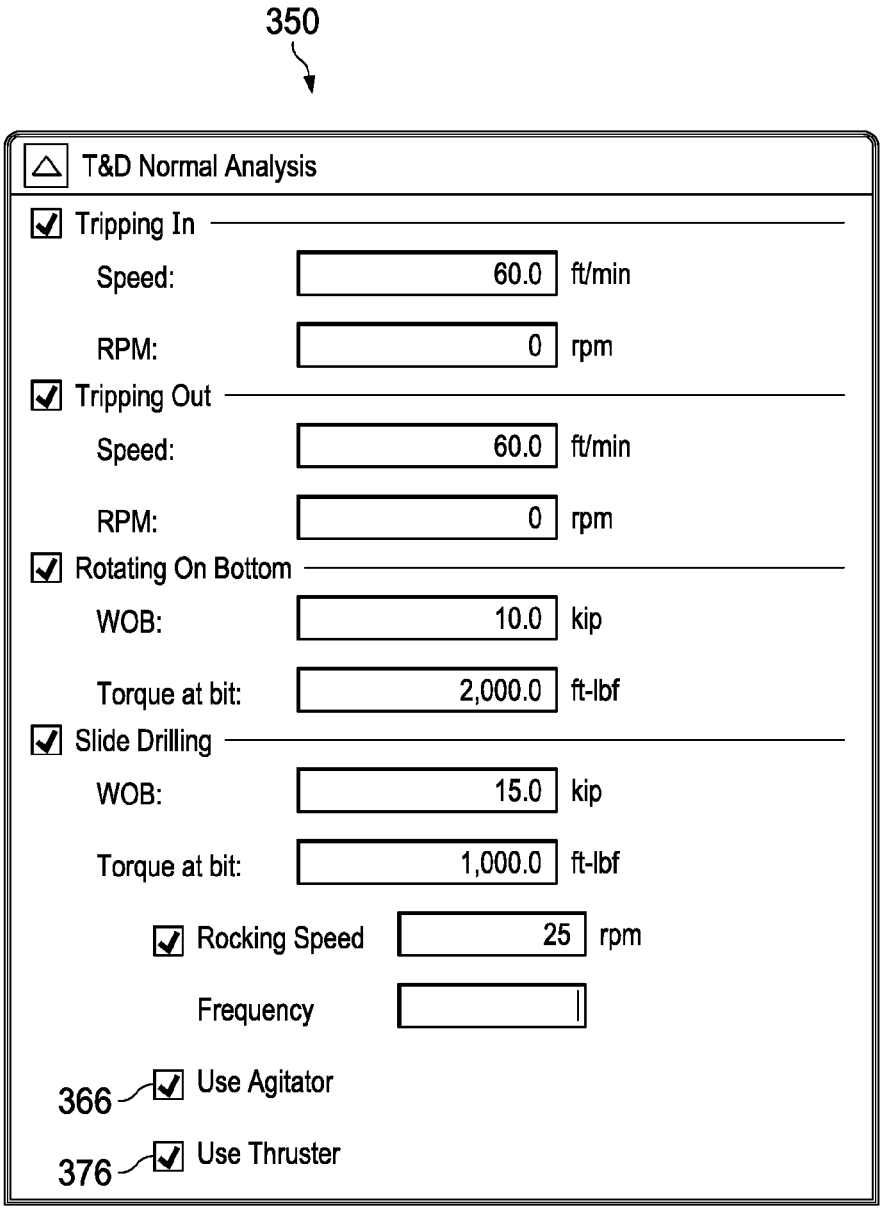
FIG. 3B is an illustration of another user interface provided by the conveyance deployment system of FIG. 1 that is similar to the user interface of FIG. 3A.

FIG. 3B is an illustration of a user interface 350 provided by the conveyance deployment system 184 of FIG. 1 that is similar to user interface 300 of FIG. 3A. As shown in FIG. 3B, additional user configurable parameters include check box 366, which an operator selects to actuate one or more oscillation tools, and check box 376, which the operator selects to actuate one or more thrusters. In one or more embodiments, where multiple oscillation tools are coupled to the conveyance, the operator is further operable to select which oscillation tool to actuate. In one or more embodiments, the operator is further operable to adjust the settings of the oscillation tools. In one or more embodiments, where multiple thrusters are coupled to the conveyance, the operator is further operable to select which thrusters to actuate. In one or more embodiments, the operator is further operable to adjust the settings of the thrusters. In some embodiments, the conveyance deployment system dynamically determines which oscillation tools to actuate and which thrusters to actuate. In some embodiments, the conveyance deployment system also dynamically adjusts the settings of the oscillation tools and the thrusters.

Figure 4:
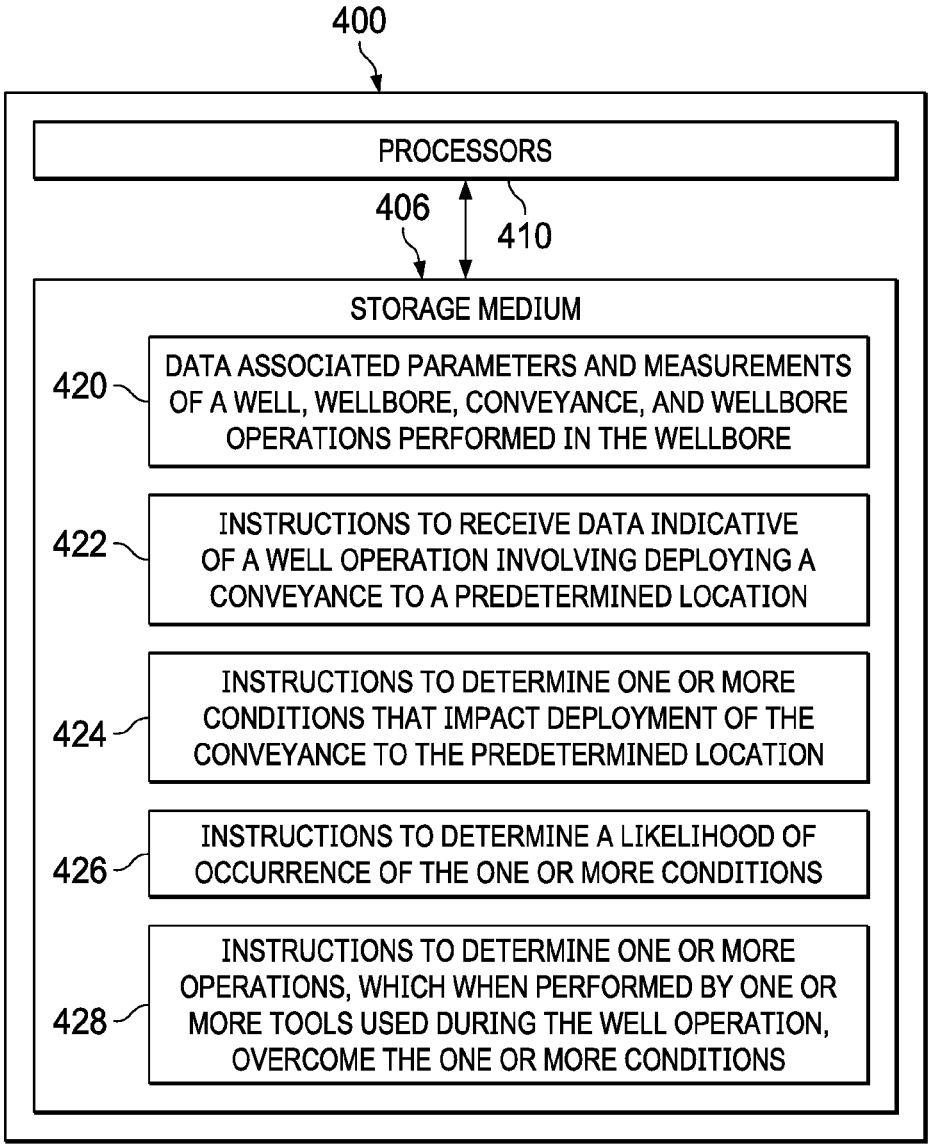
FIG. 4 is a block diagram of a conveyance deployment system.

FIG. 4 is a block diagram of a conveyance deployment system 400 that is deployable in the drilling environment of FIG. 1, or another predrilling or drilling environment. Conveyance deployment system 400 includes a storage medium 406 and processors 410. Storage medium 406 may be formed from data storage components such as, but not limited to, read-only memory (ROM), random access memory (RAM), flash memory, magnetic hard drives, solid-state hard drives, CD-ROM drives, DVD drives, floppy disk drives, as well as other types of data storage components and devices. In some embodiments, storage medium 406 includes multiple data storage devices. In further embodiments, the multiple data storage devices may be physically stored at different locations. Data indicative of parameters and measurements of a well, wellbore, and conveyance, such as well 102, wellbore 106, and conveyance 119 of FIG. 1, as well as parameters and measurements of well operations performed in wellbore 106, are transmitted to conveyance deployment system 400 and are stored at a first location 420 of storage medium 406.

As shown in FIG. 4, instructions to receive data indicative of a well operation involving deploying a conveyance to a predetermined location are stored at a second location 422 of storage medium 406, instructions to determine one or more conditions that impact deployment of the conveyance to the predetermined location are stored at a third location 424 of the storage medium 406, instructions to determine a likelihood of occurrence of the one or more conditions are stored at a fourth location 426 of storage medium 406, and instructions to determine one or more operations which when performed by one or more tools used during the well operation, overcome the one or more conditions are stored at a fifth location 428 of storage medium 406. Further, instructions to perform additional operations described herein are also stored at other locations of storage medium 406.

In some embodiments, conveyance deployment system 400 is a component of conveyance deployment system 184 of FIG. 1, or a component of another surface-based electronic device. In some embodiments, conveyance deployment system 400 is formed from conveyance deployment system 184 of FIG. 1, or from other surface-based electronic devices. In further embodiments, conveyance deployment system 400 is a component of a downhole tool that is deployed in wellbore 106 of FIG. 1. In further embodiments, parts of conveyance deployment system 400 are deployed on a surface-based electronic device, such as conveyance deployment system 184 of FIG. 1, and parts of conveyance deployment system 400 are deployed downhole.

In some embodiments, conveyance deployment system 400 contains additional components used to evaluate various well operations. For example, in some embodiments, conveyance deployment system 400 also includes drill bit 124 of FIG. 1 as well as other downhole tools or sensors used to obtain data associated with parameters and measurements of well 102, wellbore 106, conveyance 119 and well operations performed in wellbore 106 of FIG. 1. In other embodiments, conveyance deployment system 400 also includes telemetry systems described in FIG. 1, or other telemetry systems operable to transmit data between downhole tools and sensors and conveyance deployment system 184 of FIG. 1. In one or more of such embodiments, conveyance deployment system 400 also includes transmitters, receivers, transceivers, as well as other components used to transmit data between downhole tools and conveyance deployment system 184 of FIG. 1.

Figure 5:
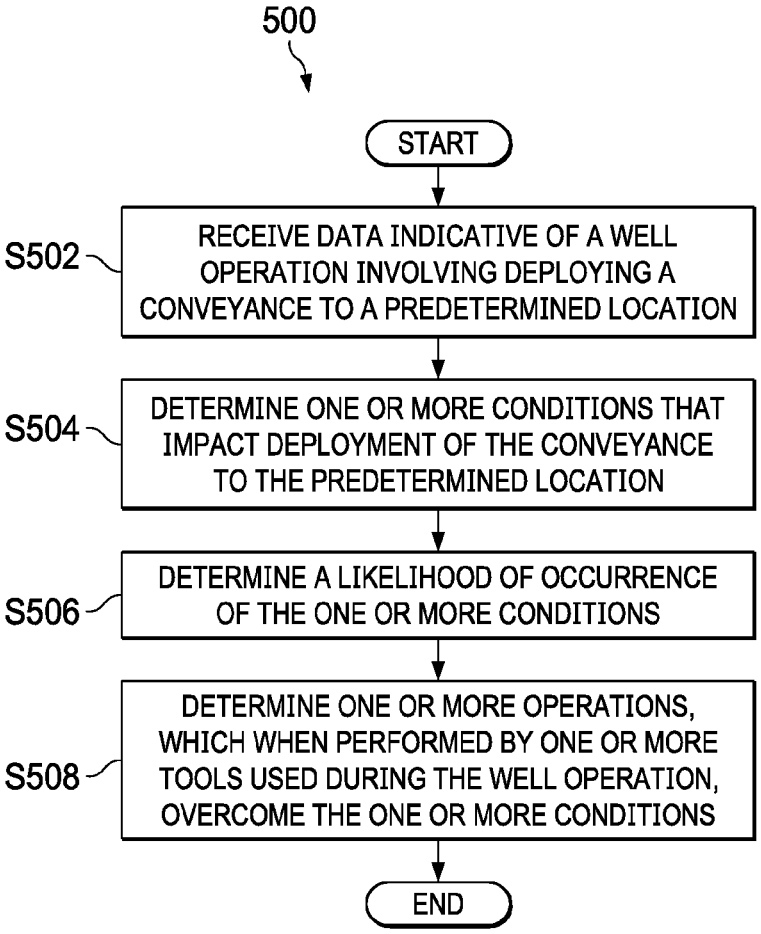
FIG. 5 is a flow chart of a process to deploy conveyances.

FIG. 5 is a flow chart of a process 500 to deploy a conveyance during a well operation. Although the operations in the process 500 are shown in a particular sequence, certain operations may be performed in different sequences or at the same time where feasible. Further, although the operations in process 500 are described to be performed by processors 410 of conveyance deployment system 400 of FIG. 4 and the processors of conveyance deployment system 184 of FIGS. 1, and 2A-2C, the operations may also be performed by one or more processors of other electronic devices operable to perform operations described herein.

At block S502, data indicative of a well operation involving deploying a conveyance to a predetermined location are received. In the embodiment of FIG. 4, the received data are stored at first location 410. At block S504, one or more conditions that impact deployment of the conveyance to the predetermined location are determined. In some embodiments, processors 410 periodically or continuously receive data indicative of conditions that impact deployment of the conveyance. At block S506, a likelihood of occurrence of the one or more conditions are determined. In some embodiments, the likelihood of occurrence of the impact is based on one or more parameters, such as, but not limited to, the type of lubricity used for the well operation, presence of the cuttings bed in the wellbore, presence of the pack-off, the dogleg in the wellbore, the keyseat in the wellbore, the degree of curvature of the wellbore, the wellbore tortuosity of the wellbore, the viscous effect of the wellbore, the diameter of the wellbore, the asperity between the conveyance used in the well operation and the wellbore, as well as other parameters related to the well operation or the well. In one or more embodiments, the processors run an uncertainty model, such as the Monte Carlo model, for a threshold number of iterations (e.g., 100 iterations, 1,000 iterations, 10,000 iterations, or a different number of iterations) to determine the likelihood of the occurrence of the issue. In one or more of such embodiments, the processors select one or more probability levels of a probability analysis of likelihood of the occurrence of one or more parameters based on an uncertainty model after the uncertainty model is run for the threshold number of iterations. For example, where one of the parameters is the presence of cuttings bed in the wellbore, three probability levels (or a different number of probability levels) indicative of 10% likelihood, 50% likelihood, and 90% likelihood are selected and the processors determine whether the probability of the presence of cuttings bed in the wellbore reaches one or more of the probability levels. In one or more embodiments, a threshold number (e.g., 10, 100, 1,000, or another number) of iterations of an uncertainty model is generated, and the likelihood of occurrence is based on a distribution of the threshold number of iterations of the uncertainty model.

At block S508, one or more operations which, when performed by one or more tools used during the well operation, overcome the one or more conditions are determined. As shown in the embodiment of FIG. 2C, processors of conveyance deployment system 184 determine to actuate oscillation tools 220 and 222 to generate lateral movements of sections 276 and 274, respectively. Further processors of conveyance deployment system 184 also determine to actuate thruster 232 to generate a thrusting force towards drill bit 124 and in an axial direction relative to the direction drill bit 124 is moving. Further processors of conveyance deployment system 184 also determine to engage a top drive to rock conveyance 119. In some embodiments, the processors determine whether to activate one or more of oscillation tools 220 and 222, thruster 232, and the top drive and the operating settings of the respective tools based on the likelihood of occurrence of the one or more conditions. In some embodiments, as one or more conditions change during a well operation, the processors of conveyance deployment system 184 also dynamically changes or updates the operations performed by the tools to address new conditions.

In some embodiments, the processes described herein are performed by a neural network component of a system, such as conveyance deployment system 400 of FIG. 4 or a neural network assessable by the system. In some embodiments, the determined operations are provided to an electronic device of an operator that is operable to actuate one or more tools to facilitate deployment of the conveyance to overcome the conditions. In one or more of such embodiments, the likelihood of occurrence and the parameters of the well operation are also provided to the operator. In some embodiments, the processors provide the determined operations to an electronic device that is operable to dynamically actuate the one or more tools to facilitate deployment of the conveyance without support from an operator. In one or more of such embodiments, the processors dynamically actuate the one or more tools in response to determining that the likelihood of an occurrence is greater than a threshold rate (e.g., 10%, 50%, 90%, or another rate). In one or more embodiments, the processors propose actuating the one or more tools to an operator and actuates the tools after the operator approves such proposal. In one or more embodiments, the processors propose actuating the tools to the operator and actuates the tools if the operator does not reject the proposal within a threshold period of time.

For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a computer-implemented method to deploy a conveyance during a well operation, the method comprising: receiving data indicative of a well operation involving deploying a conveyance to a predetermined location; determining one or more conditions that impact deployment of the conveyance to the predetermined location; determining a likelihood of occurrence of the one or more conditions; and determining one or more operations which, when performed by one or more tools used during the well operation, overcome the one or more conditions.

Clause 2, the computer-implemented method of clause 1, further comprising providing the one or more operations to an electronic device of an operator to approve the one or more operations.

Clause 3, the computer-implemented method of clauses 1 or 2, further comprising providing the one or more operations to an electronic device operable to dynamically approve the one or more operations.

Clause 4, the computer-implemented method of any of clauses 1-3, further comprising dynamically performing the one or more operations after determining the one or more operations.

Clause 5, the computer-implemented method of clause 4, wherein dynamically performing the one or more operations comprises dynamically performing the one or more operations in response to determining that the likelihood of occurrence is greater than a threshold.

Clause 6, the computer-implemented method of any of clauses 1-5, wherein determining the one or more operations comprises determining the one or more conditions based on the one or more conditions and the likelihood of occurrence of the one or more conditions.

Clause 7, the computer-implemented method of any of clauses 1-6, wherein the one or more conditions comprises one or more properties of the conveyance.

Clause 8, the computer-implemented method of any of clauses 1-7, wherein the one or more conditions comprise one or more downhole properties of a wellbore in which the conveyance is deployed.

Clause 9, the computer-implemented method of any of clauses 1-8, further comprising: determining an oscillating frequency of an oscillation tool, which when oscillating at the oscillating frequency, overcomes the one or more conditions; and requesting the oscillation tool to operate at the oscillating frequency to overcome the one or more conditions, wherein operation of the oscillation tool at the oscillation frequency is an operation of the one or more operations.

Clause 10, the computer-implemented method of clause 9, further comprising: determining a second oscillating frequency of a second oscillation tool, which when oscillating at the second oscillation frequency while the oscillation tool operates at the oscillating frequency, overcomes the one or more conditions; and requesting the second oscillation tool to operate at the second oscillating frequency to overcome the one or more conditions, wherein operation of the second oscillation tool at the second oscillation frequency is an operation of the one or more operations.

Clause 11, the computer-implemented method of any of clauses 1-10, further comprising: determining a number of rotations to rotate the conveyance, which when rotated the number of rotations in a first direction and rotated the number of rotations in a second and opposite direction, overcomes the one or more conditions; and requesting a top drive that is coupled to the conveyance to rotate the conveyance the number of rotations in the first direction then rotate the conveyance the number of rotations in the second direction, wherein rotation of the conveyance the number of rotations in the first direction and then in the second direction is an operation of the one or more operations.

Clause 12, the computer-implemented method of any of clauses 1-11, further comprising: determining a rotation speed of the conveyance, which when rotated at the rotation speed, overcomes the one or more conditions; and requesting a top drive that is coupled to the conveyance to rotate the conveyance at the rotation speed, wherein rotation of the conveyance at the rotation speed is an operation of the one or more operations.

Clause 13, the computer-implemented method of any of clauses 1-12, wherein the one or more operations comprise rotating the conveyance, generating a thrust force in an axial direction, and generating oscillations in lateral directions.

Clause 14, a conveyance deployment system, comprising: a storage system; and one or more processors operable to: receive data indicative of a well operation involving deploying a conveyance to a predetermined location; determine one or more conditions that impact deployment of the conveyance to the predetermined location; determine a likelihood of occurrence of the one or more conditions; and determine, based on the one or more conditions and the likelihood of occurrence of the one or more conditions, one or more operations which, when performed by one or more tools used during the well operation, overcome the one or more conditions.

Clause 15, The conveyance deployment system of claim 14, wherein the one or more tools comprise at least one of a top drive that is coupled to the conveyance, one or more oscillation tools configured to oscillate in lateral directions relative to a movement direction of a drill bit that is coupled to the conveyance, and one or more thrusters configured to thrust the conveyance towards the drill bit and in a direction axial to the movement direction of the drill bit.

Clause 17, the system of clause 15, wherein the one or more processors operable to: determine an oscillating frequency of an oscillation tool of the one or more oscillation tools, which when oscillating at the oscillating frequency, overcomes the one or more conditions; and request the oscillation tool to operate at the oscillating frequency to overcome the one or more conditions, wherein operation of the oscillation tool at the oscillation frequency is an operation of the one or more operations.

Clause 17, the system of clause 16, wherein the one or more processors operable to: determine a thrust force of a thruster of the one or more thrusters, which when generating the thrust force, overcomes the one or more conditions; and request the thruster to generate the thrust force to overcome the one or more conditions, wherein generation of the thrust force by the thruster is an operation of the one or more operations.

Clause 18, the system of clause 17, wherein the one or more processors operable to: determine a number of rotations to rotate the conveyance, which when rotated the number of rotations in a first direction and rotated the number of rotations in a second and opposite direction, overcomes the one or more conditions; and request a top drive that is coupled to the conveyance to rotate the conveyance the number of rotations in the first direction then rotate the conveyance the number of rotations in the second direction, wherein rotation of the conveyance the number of rotations in the first direction and then in the second direction is an operation of the one or more operations.

Clause 19, a non-transitory machine-readable medium comprising instructions stored therein which, when executed by one or more processors, cause the one or more processors to perform operations comprising: receiving data indicative of a well operation involving deploying a conveyance to a predetermined location; determining one or more conditions that impact deployment of the conveyance to the predetermined location; determining a likelihood of occurrence of the one or more conditions; and determining, based on the one or more conditions and the likelihood of occurrence of the one or more conditions, one or more operations which, when performed by one or more tools used during the well operation, overcome the one or more conditions.

Clause 20, the non-transitory machine-readable medium of clause 19, wherein the instructions when executed by one or more processors, cause the one or more processors to perform operations comprising dynamically performing the one or more operations after determining the one or more operations.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A computer-implemented method to deploy a conveyance during a well operation, the method comprising:

receiving data indicative of a well operation involving deploying a conveyance to a predetermined location;

determining one or more conditions that impact deployment of the conveyance to the predetermined location;

determining a likelihood of occurrence of the one or more conditions;

determining one or more operations which, when performed by one or more tools used during the well operation, overcome the one or more conditions;

determining a thrust force of a thruster, which when generating the thrust force, overcomes the one or more conditions;

actuating the thruster to generate the thrust force to overcome the one or more conditions, wherein generation of the thrust force by the thruster is an operation of the one or more operations; and determining a number of rotations to rotate the conveyance, which when rotated the number of rotations in a first direction and rotated the number of rotations in a second and opposite direction, overcomes the one or more conditions; and requesting a top drive that is coupled to the conveyance to rotate the conveyance the number of rotations in the first direction then rotate the conveyance the number of rotations in the second direction, wherein rotation of the conveyance the number of rotations in the first direction and then in the second direction is an operation of the one or more operations.

2. The computer-implemented method of claim 1, further comprising providing the one or more operations to an electronic device of an operator to approve the one or more operations.

3. The computer-implemented method of claim 1, further comprising providing the one or more operations to an electronic device operable to dynamically approve the one or more operations.

4. The computer-implemented method of claim 1, further comprising dynamically performing the one or more operations after determining the one or more operations.

5. The computer-implemented method of claim 4, wherein dynamically performing the one or more operations comprises dynamically performing the one or more operations in response to determining that the likelihood of occurrence is greater than a threshold.

6. The computer-implemented method of claim 1, wherein determining the one or more operations comprises determining the one or more conditions based on the one or more conditions and the likelihood of occurrence of the one or more conditions.

7. The computer-implemented method of claim 1, wherein the one or more conditions comprises one or more properties of the conveyance.

8. The computer-implemented method of claim 1, wherein the one or more conditions comprise one or more downhole properties of a wellbore in which the conveyance is deployed.

9. The computer-implemented method of claim 1, further comprising:

determining an oscillating frequency of an oscillation tool, which when oscillating at the oscillating frequency, overcomes the one or more conditions; and requesting the oscillation tool to operate at the oscillating frequency to overcome the one or more conditions, wherein operation of the oscillation tool at the oscillation frequency is an operation of the one or more operations.

10. The computer-implemented method of claim 9, further comprising:

determining a second oscillating frequency of a second oscillation tool, which when oscillating at the second oscillation frequency while the oscillation tool operates at the oscillating frequency, overcomes the one or more conditions; and requesting the second oscillation tool to operate at the second oscillating frequency to overcome the one or more conditions, wherein operation of the second oscillation tool at the second oscillation frequency is an operation of the one or more operations.

11. The computer-implemented method of claim 1, wherein the one or more operations comprise rotating the conveyance, generating a thrust force in an axial direction, and generating oscillations in lateral directions, wherein the axial direction and the lateral directions are relative to a movement direction of a drill bit coupled to the conveyance.

12. A conveyance deployment system, the system comprising:

a storage system; and one or more processors to couple to the storage system and operable to:

receive data indicative of a well operation involving deploying a conveyance to a predetermined location;

determine one or more conditions that impact deployment of the conveyance to the predetermined location;

determine a likelihood of occurrence of the one or more conditions;

determine, based on the one or more conditions and the likelihood of occurrence of the one or more conditions, one or more operations which, when performed by one or more tools used during the well operation, overcome the one or more conditions;

determine a thrust force of a thruster, which when generating the thrust force, overcomes the one or more conditions;

actuate the thruster to generate the thrust force to overcome the one or more conditions, wherein generation of the thrust force by the thruster is an operation of the one or more operations;

determine a number of rotations to rotate the conveyance, which when rotated the number of rotations in a first direction and rotated the number of rotations in a second and opposite direction, overcomes the one or more conditions; and request a top drive that is coupled to the conveyance to rotate the conveyance the number of rotations in the first direction then rotate the conveyance the number of rotations in the second direction, wherein rotation of the conveyance the number of rotations in the first direction and then in the second direction is an operation of the one or more operations.

13. The conveyance deployment system of claim 12, wherein the one or more tools comprise at least one of a top drive that is coupled to the conveyance, one or more oscillation tools configured to oscillate in lateral directions relative to a movement direction of a drill bit that is coupled to the conveyance, and one or more thrusters configured to thrust the conveyance towards the drill bit and in a direction axial to the movement direction of the drill bit.

14. The system of claim 13, wherein the one or more processors are operable to:

determine an oscillating frequency of an oscillation tool of the one or more oscillation tools, which when oscillating at the oscillating frequency, overcomes the one or more conditions; and request the oscillation tool to operate at the oscillating frequency to overcome the one or more conditions, wherein operation of the oscillation tool at the oscillation frequency is an operation of the one or more operations.

15. A non-transitory machine-readable medium comprising instructions stored therein which, when executed by one or more processors, cause the one or more processors to perform operations comprising:

receiving data indicative of a well operation involving deploying a conveyance to a predetermined location;

determining one or more conditions that impact deployment of the conveyance to the predetermined location;

determining a likelihood of occurrence of the one or more conditions;

determining, based on the one or more conditions and the likelihood of occurrence of the one or more conditions, one or more operations which, when performed by one or more tools used during the well operation, overcome the one or more conditions;

determining a thrust force of a thruster, which when generating the thrust force, overcomes the one or more conditions;

actuating the thruster to generate the thrust force to overcome the one or more conditions, wherein generation of the thrust force by the thruster is an operation of the one or more operations;

determining a number of rotations to rotate the conveyance, which when rotated the number of rotations in a first direction and rotated the number of rotations in a second and opposite direction, overcomes the one or more conditions; and requesting a top drive that is coupled to the conveyance to rotate the conveyance the number of rotations in the first direction then rotate the conveyance the number of rotations in the second direction, wherein rotation of the conveyance the number of rotations in the first direction and then in the second direction is an operation of the one or more operations.

16. The non-transitory machine-readable medium of claim 15, wherein the instructions when executed by one or more processors, cause the one or more processors to perform operations comprising dynamically performing the one or more operations after determining the one or more conditions.

17. The non-transitory machine-readable medium of claim 15, wherein the one or more tools comprise at least one of a top drive that is coupled to the conveyance, one or more oscillation tools configured to oscillate in lateral directions relative to a movement direction of a drill bit that is coupled to the conveyance, and one or more thrusters configured to thrust the conveyance towards the drill bit and in a direction axial to the movement direction of the drill bit.

18. The non-transitory machine-readable medium of claim 17, wherein the one or more processors are operable to:

determine an oscillating frequency of an oscillation tool of the one or more oscillation tools, which when oscillating at the oscillating frequency, overcomes the one or more conditions; and request the oscillation tool to operate at the oscillating frequency to overcome the one or more conditions, wherein operation of the oscillation tool at the oscillation frequency is an operation of the one or more operations.

19. The non-transitory machine-readable medium of claim 18, wherein the one or more processors operable to:

determine a second oscillating frequency of a second oscillation tool, which when oscillating at the second oscillation frequency while the oscillation tool operates at the oscillating frequency, overcomes the one or more conditions; and request the second oscillation tool to operate at the second oscillating frequency to overcome the one or more conditions, wherein operation of the second oscillation tool at the second oscillation frequency is an operation of the one or more operations.

20. The non-transitory machine-readable medium of claim 15, wherein the one or more operations comprise rotating the conveyance, generating a thrust force in an axial direction, and generating oscillations in lateral directions, wherein the axial direction and the lateral directions are relative to a movement direction of a drill bit coupled to the conveyance.

* * * * *